US005988711A

United States Patent [19]

Toma

[11] Patent Number: 5,988,711

[45] Date of Patent: Nov. 23, 1999

[54] ARRESTING/RELEASE DEVICE FOR A SWING CATCH OF A WORKING CURRENT DOOR OPENER

[75] Inventor: Augustin Toma, Balingen, Germany

[73] Assignee: eff-eff Fritz Fuss GmbH & Co. Kommanditgesellschaft auf Aktien, Albstadt-Ebingen, Germany

[21] Appl. No.: 09/022,534

[22] Filed: Feb. 12, 1998

[30] Foreign Application Priority Data

Feb. 26, 1997 [DE] Germany ..... 197 07 759

[51] Int. Cl.[6] ..... E05B 15/02

[52] U.S. Cl. ..... 292/341.16; 292/341.12; 292/201

[58] Field of Search ..... 292/341.16, 341.17, 292/201, 341.13, 341.12

[56] References Cited

U.S. PATENT DOCUMENTS

| | | | |
|---|---|---|---|
| 1,417,430 | 5/1922 | Tulloch et al. | 292/201 |
| 4,211,443 | 7/1980 | Butts et al. | 292/341.16 |
| 4,219,227 | 8/1980 | Grabner et al. | 292/216 |
| 4,656,850 | 4/1987 | Tabata | 70/276 |
| 4,756,566 | 7/1988 | Logas | 292/341.16 |
| 4,815,776 | 3/1989 | Fuss | 292/341.16 |
| 4,917,425 | 4/1990 | Logas | 292/341.16 |
| 5,050,840 | 9/1991 | Kondo et al. | 251/129.15 |
| 5,118,150 | 6/1992 | Jarrett | 292/341.16 |
| 5,439,262 | 8/1995 | Fuss et al. | 292/341.16 |
| 5,490,699 | 2/1996 | Uyeda | 292/341.16 |

FOREIGN PATENT DOCUMENTS

| | | | |
|---|---|---|---|
| 279878 | 2/1987 | European Pat. Off. | 47/6 |
| 366864 | 10/1906 | France | 292/201 |
| 2818991 | 11/1979 | Germany | 292/341.17 |
| 2289915 | 12/1995 | United Kingdom | 47/6 |

*Primary Examiner*—Darnell M. Boucher
*Assistant Examiner*—Clifford B Vaterlaus
*Attorney, Agent, or Firm*—Oblon, Spivak, McClelland, Maier & Neustadt, P.C

[57] ABSTRACT

The invention relates to an arresting/release device for a swing catch of a working current door opener with a catch lever, which arrests or releases the swing catch, a first safety lever, which maintains the catch lever in the arrested position and is pivotable with the aid of an electromagnet into a position releasing the catch lever, and with a second safety lever, which acts on the first safety lever for impact protection of the catch lever.

In order to achieve an impact protection advantageous from the manufacturing and installation standpoint, the second safety lever is constituted by a mechanically decoupled lever of low mass mounted in its center of gravity. This symmetrically constructed, vibration-proof, second safety lever secures the first safety lever in an impact-preventing position and is magnetically coupled to and pivotable with the coil core, which is made from a soft magnetic material and has a relatively long acceleration path.

16 Claims, 3 Drawing Sheets

ARRESTING/RELEASE DEVICE FOR A SWING CATCH OF A WORKING CURRENT DOOR OPENER

BACKGROUND OF THE INVENTION

1. Field of the Invention

The present invention relates to an arresting/release device for a swing catch of a working current door opener with a catch lever, which arrests or releases the swing catch, a first safety lever, which keeps the catch lever in the arrested position and is pivotable with the aid of an electromagnet into a position releasing the catch lever, and with a second safety lever, which acts on the safety lever for the impact protection of the catch lever.

Electric door openers are generally known and of a standard nature. A distinction is made between working and no-load current designs. Fundamentally the function of the electric door opener is based on the fact that a changer or catch lever is held by a first safety lever acting as the armature of an electromagnet in the pivoting area of the swing catch of the door opener, until in the case of energization of the electromagnet the safety lever is actuated and adjusted accompanied by the release of the catch lever and therefore the swing catch.

Working current door openers have an unlocking tendency in the case of shocks, vibrations and sudden force action, in that the safety lever is disengaged from the catch lever and the swing catch is released. The otherwise reliably and securely operating working current door openers can only be used to a limited extent or not at all in working environments where there is a vibration hazard, e.g. in vehicles used for transporting money or heavy steel doors.

2. Description of the Related Art

EP 279 878 A1 discloses an arresting/release device with an impact preventer, which comprises a second safety lever for locking a first safety lever referred to as the inner armature, as well as a further safety lever referred to as the outer armature. The second safety or locking lever is articulated in the pivot pin of the changer or catch lever and extends with a control edge and a detent, which cooperate with the safety levers referred to as the inner and outer armatures, over and beyond the locking lever. On energizing an electromagnet the outer armature acting on the control edge firstly deflects the locking lever, releases the locking system and after a predeterminable advance takes with it the inner armature for releasing the catch lever.

The arresting/release device of DE 44 18 863 C1 has two safety levers designed in an opposing manner and which cooperate with a nose on the changer. The first safety lever is constructed as an alternate or two-way arm of the armature of an electromagnet and is provided with a nose, which in the arrested state engages in blocking manner on the changer nose constructed in opposing manner. In the release state the first safety lever is deflected from its rest position towards the changer pivot axis, so that both noses engage behind one another in complimentary manner and have a releasing action. The second safety lever pivotably arranged on the first safety lever and resiliently biased against the changer, cooperates by means of a control edge with the changer in such a way that it is deflected by the changer in scissor-like manner in the case of a deflection of the first safety lever into the open position. The changer with nose can then pass between the stop on the second safety lever and the nose on the first safety lever. Impact on the housing leads to an equidirectional deflection, but not to a spread-apart position, so that at least one of the two safety levers maintains the arresting function.

These known arresting/release devices with impact preventer function reliably and securely. However, they are relatively complicated as regards manufacture and installation due to the design.

SUMMARY OF THE INVENTION

The object of the invention is to provide an arresting/release device for a swing catch of a working current door opener, which has a particularly simple design, allows efficient manufacture and installation and ensures a reliable, secure function even in the case of a preload on the swing catch.

According to the invention this object is achieved in that the second safety lever is a mechanically decoupled, low mass lever mounted in its centre of gravity adjustable from a position arresting the first safety lever by magnetic coupling to an armature of the electromagnet into a position releasing the first safety lever.

The invention is based on the idea of securing a first safety lever with a second safety lever, which is constructed as a mechanically decoupled lever mounted in its centre of gravity.

No vibrations or shocks are transferred to the mechanically completely decoupled, weight-compensated, second safety lever having a relatively low weight. However, the second safety lever is designed in such a way that it can be mechanically coupled to an electromagnet and pivoted and therefore acts as an impact preventing armature.

Appropriately the second safety lever is placed in the action field of an electromagnet with a magnetizable coil core, which is preferably made from a soft magnetic material, has a relatively high weight and a long acceleration path. Although the first safety lever and coil core react to vibrations and shocks due to a lack of weight compensation, the second, mechanically decoupled safety lever remains in its position arresting the first safety lever, so that the catch lever is not unlocked and the swing catch is not released.

In an appropriate construction, the second safety lever is provided with two symmetrically constructed lever arms arranged tangentially on a pivot pin and which in an impact-preventing arresting position are oriented virtually vertically and in opposition to one another and are preferably located in the vicinity of an inner housing wall. A first lever arm oriented in the catch lever direction is constructed for positive and/or non-positive engagement on the first safety lever, whilst a second lever arm magnetically cooperating with the coil core is oriented upwards and in the impact-preventing position is located adjacent to the inner housing wall.

Appropriately the pivoting or rotary movement of the second safety lever is limited, in order to prevent sticking on the magnetized coil. The path limitation is achieved in a particularly simple manner in that the first lever arm, in the case of a clearly defined pivoting or rotation of the second safety lever about a horizontal pivoting axis, strikes against the inner housing.

The second safety lever is biased in its impact-preventing position with the aid of a spring, particularly a compression spring, which is supported on the housing side and on the first lever arm and consequently prevents a rotary movement for releasing the first safety lever and the catch lever.

In an appropriate arrangement a coil with a horizontally adjustable coil core of relatively high weight and long acceleration path is positioned between the first and second safety levers, above the catch lever and also the swing catch.

An operative connection between the coil and the first safety lever is obtained by means of a coil pin, which is connected to and adjustable with the coil core and which can e.g. be guided through a bottom area of the coil. When the coil is energized the coil core is magnetized, accelerated against the tension of a coil spring and moved into the coil. Therefore the coil pin is moved out over and beyond the coil bottom and engages with the first safety lever.

It is advantageous to construct the electromagnet in such a way that on attracting or sucking in the coil core into the coil there is a venting of the gap formed between the coil core and the coil in order to implement an arresting and release position. Venting can be achieved by a corresponding construction of the coil core and/or the coil former. Thus, a vent hole can be provided in the coil core, e.g. axially parallel to the horizontal longitudinal axis of the coil core. An air compression in the gap or conversely a vacuum in the gap are also avoided, if e.g. a vent groove is constructed on the coil former, so that the air can escape or be sucked laterally on the coil core.

In an appropriate construction, the first safety lever is constructed as a toggle lever and is pivotable in counter-clockwise direction about a pivoting axis parallel to the pivoting axis of the second safety lever and the catch lever. It passes from a secured position locking the catch lever and consequently the second safety lever into a desecured position releasing the catch lever.

The cooperation of the coil pin with the coil core is particularly advantageous. On drawing the coil core into the coil the first safety lever is pressed by the coil pin into an unlocked position. Simultaneously and as a result of the magnetic coupling to the coil core, the second safety lever is pivoted out of its impact-preventing position.

The arresting position of the coil core, the first safety lever and the second safety lever is in each case ensured by compression springs.

The arresting/release device according to the invention has a simple, space-saving design leading to inexpensive manufacture and installation. The mechanically completely unlocked second safety lever magnetically adjustable with the coil core prevents an unlocking in the case of vibrations or shocks and ensures reliable operation in the case of a preload.

BRIEF DESCRIPTION OF THE DRAWINGS

The invention is described in greater detail hereinafter relative to the highly diagrammatic drawings, wherein show.

DESCRIPTION OF THE PREFERRED EMBODIMENTS

Figure 1:
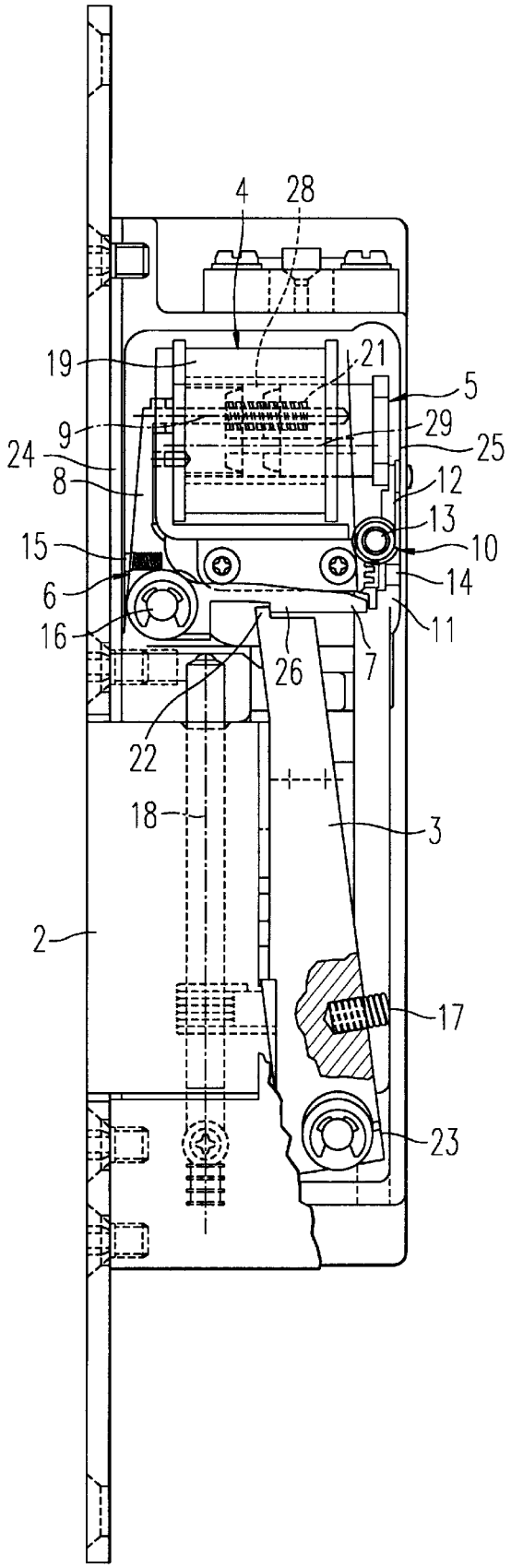
FIG. 1 A side view of an inventive arresting/release device in the arrested position with the housing cover removed.

FIG. 1 shows in a part sectional view a working current door opener with a swing catch 2, a catch lever 3, a first safety lever 6 and a second safety lever 10, as well as an electromagnet 4 with a coil 19 and a horizontally displaceable coil core 5, which acts as an armature on the second safety lever 10.

In the arrested position shown in FIG. 1, the catch lever 3 engages on the swing catch 2 and prevents its adjustment for opening a not shown door. The catch lever 3 is adjustable about a horizontal pivoting axis 23 and is held in the represented arrested position by a spring 17. In this arrested position a detent 22, which is constructed on a front end region of the catch lever 3, engages in a recess with a stop edge 26 of a first lever arm 7 of the first safety lever 6.

The first safety lever 6 is constructed as a toggle lever and is counter-clockwise pivotable about a pivoting axis 16, which is parallel to the pivoting axis 23 of the catch lever 3 and to the pivoting axis 13 of the second safety lever 10. The first lever arm 7 is moved out of the locking position into a release position (cf. FIG. 3). The pivoting movement is brought about by a coil pin 9, which is guided in a bottom-side area of the coil 19 and is fixed to the coil core 5.

The coil core 5 is constructed as an armature of the coil 19 and is made from a soft magnetic material. When current flows through the coil 19, the coil core 5 is magnetized and drawn into the coil 19, the coil pin 9 and second safety lever 10 also being moved.

Figure 2:
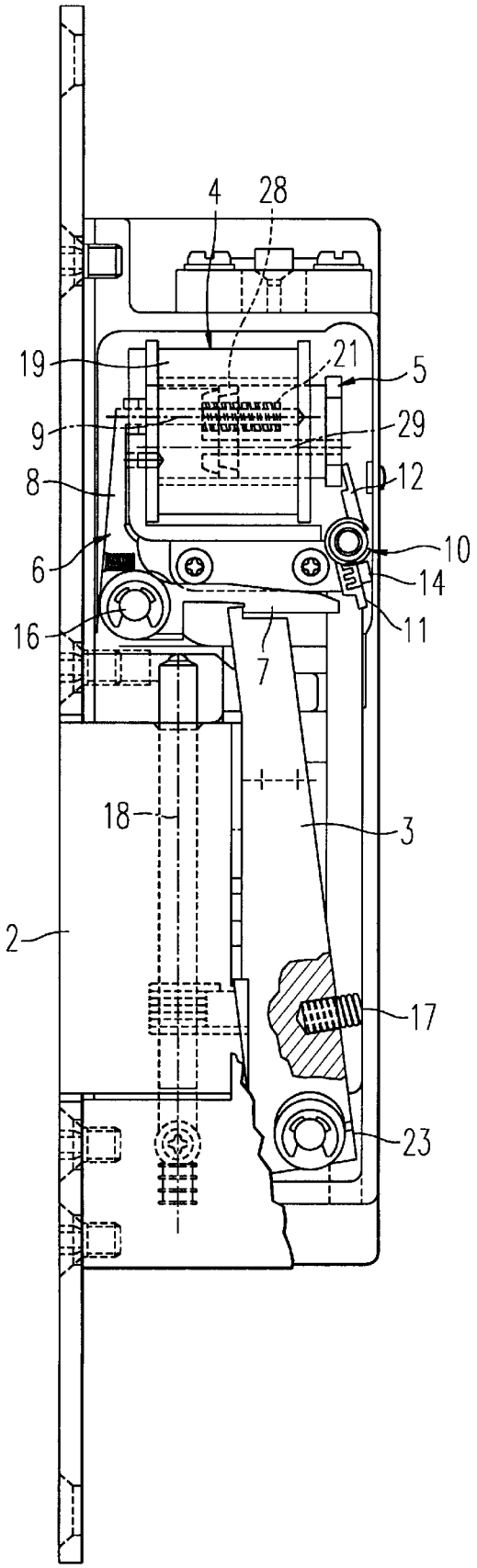
FIG. 2 An inventive arresting/release device according to FIG. 1 with energized field coil.
Figure 3:
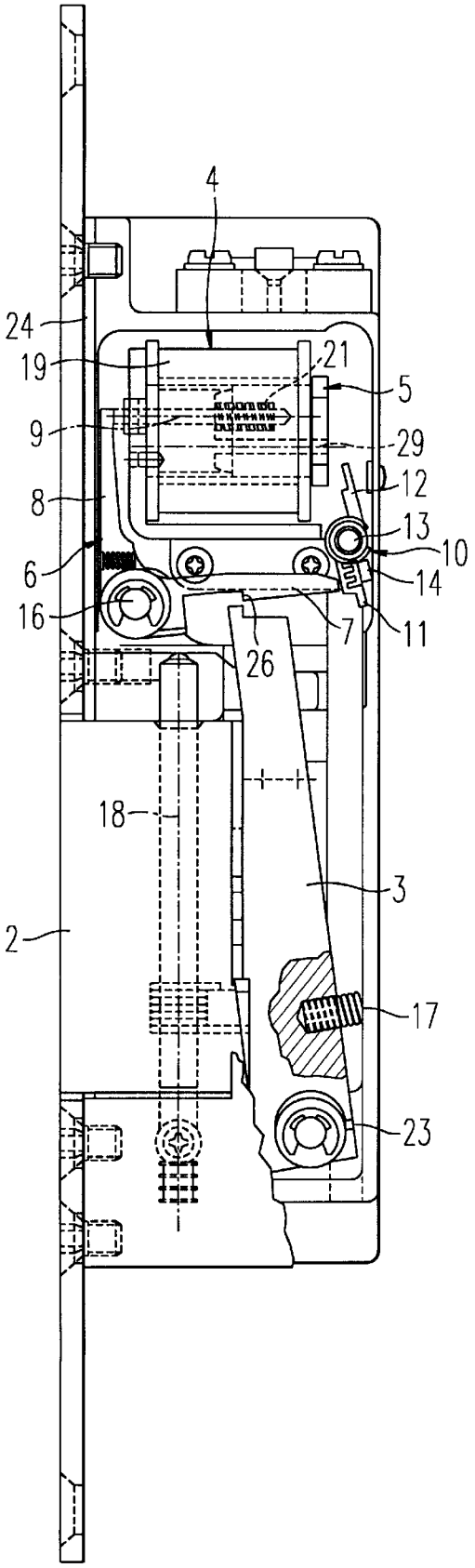
FIG. 3 An inventive arresting/release device according to FIGS. 1 and 2 with energized field coil and released catch lever.

Whilst the displacement of the coil pin 9 leads to a pivoting of the first safety lever 6, the second safety lever 10 is adjusted by means of a magnetic coupling in the area of its second lever arm 12 on the coil core 5 and is pivoted from its impact-preventing position according to FIG. 1 firstly into the position shown in FIG. 2 and then into the release position shown in FIG. 3.

The first safety lever 6 is preloaded in the arrested position shown in FIG. 1 by a compression spring 15, which is supported on the housing side and on a second lever arm 8. It is advantageous to place the coil 19 with coil core 5 between the first safety lever 6 located close to a locking plate-side housing wall 24 and the second safety lever 10 which is virtually adjacent to an inside housing wall 25.

FIG. 1 illustrates the symmetrical construction and weight-compensated mounting of the second safety lever 10, which is only magnetically couplable to the coil core 5.

FIG. 2 shows the path limitation of the second safety lever 10 via the first lever arm 11. Following a predeterminable rotary movement, the first lever arm 11 strikes on the inside housing wall 25 and consequently decouples the second lever arm 12 from the coil core 5. Thus, any sticking of the second safety lever 10 on the coil core 5 is prevented.

Both lever arms 11, 12 of the second safety lever 10 are constructed for positive and non-positive engagement on the first lever arm 7 of the first safety lever 6 and on the coil core 5. The impact-preventing locking or engagement behind takes place in the vicinity of a terminal end region of the first lever arm 7 of the first safety lever 6.

The adjustment of the coil core 5 on energizing the electromagnet 4 into the coil 19 is directionally opposed by a compression spring 21. In the unenergized state the coil core 5 projects out of the coil 19 and extends virtually up to the inside housing wall 25. The rotary movement of the second safety lever 10 also takes place counter to the bias of a spring 14, which is supported on the inside housing wall 25 and on the first lever arm 11 of the second safety lever 10.

In order to ensure that on drawing the coil core 5 into the energized coil 19 an air compression does not take place in a gap 28 and which would in particular prevent the unlocking process, the coil core 5 has a vent hole 29. This vent hole 29 ensures that the compressed air of the gap 28 can escape or conversely air can be sucked into the gap 28.

In the phase shown in FIG. 2, the second safety lever 10 magnetically coupled to the coil core 5 is pivoted out of its impact-preventing position. Since, however, the first safety lever 6 still arrests the catch lever 3 with its first lever arm 7, in the case of a corresponding pressure the swing catch 2 cannot be pivoted about its longitudinal axis 18 and the door remains closed.

FIG. 3 shows an unlocked position of the catch lever 3 of the first safety lever 6 and the second safety lever 10. In this position the first lever arm 11 of the second safety lever 10 engages on the inside of the housing wall 25 and prevents a further entrainment and sticking on the coil core 5 almost completely received in the coil 19. The first safety lever 6 has been pivoted by the coil pin 9 and engages with its second lever arm 8 virtually on the locking plate-side housing wall 24. The first lever arm 7 of the first safety lever 6 runs approximately horizontally and has on its underside the stop edge 26 for maintaining the arresting of the catch lever 3. To open the door the swing catch 2 can be pivoted about its longitudinal axis 18, because the catch lever 3 is unlocked and clockwise adjustable counter to the tension of the compression spring 17.

What I claim is:

1. An electric door opener comprising:

a swing catch;

a catch lever for releasing the swing catch;

a first safety lever which holds said catch lever in an arrested position, said first safety lever being pivotally moveable;

an electromagnet including an armature which is magnetically coupled to said first safety lever so that when the electromagnet is actuated, the first safety lever is pivotally moved so as to release said catch lever;

a second safety lever which acts on said first safety lever to prevent accidental release of the catch lever during impact, said second safety lever being mechanically decoupled from said first safety lever and being magnetically coupled to said armature so that when said electromagnet is actuated, said second safety lever releases said first safety lever.

2. An electric door opener according to claim 1, characterized in that the second safety lever, which is arranged in vibration-proof manner, is symmetrically constructed and magnetically adjustable with a coil core as the armature of an electromagnet.

3. An electric door opener according to claim 1, characterized in that the second safety lever has a first and a second lever arm, which are arranged tangentially and rigidly on a pivot axis.

4. An electric door opener according to claim 3, characterized in that the first lever arm of the second safety lever is spring-loaded and secures the first safety lever in a position for arresting the catch lever.

5. An electric door opener according to claim 3, characterized in that the second lever arm of the second safety lever is arranged in oppositely directed manner to the first lever arm and for magnetic coupling with the coil core and there is a path limitation of the magnetic coupling by a housing-side engagement of the first lever arm.

6. An electric door opener according to claim 2, characterized in that the coil core of the electromagnet has a coil pin, which traverses a coil at the bottom for mechanical urging of the first safety lever and is adjustable with the coil core.

7. An electric door opener according to claim 2, characterized in that the coil core of the electromagnet has a high mass and long acceleration path.

8. An electric door opener according to claim 3, characterized in that the first safety lever is constructed as a toggle lever and is pivotable about a pivoting axis, which is parallel to the pivoting axis of the second safety lever and to a pivoting axis of the catch lever.

9. An electric door opener according to claim 1, characterized in that the first safety lever has a first lever arm and a second lever arm substantially at right angles to the first lever arm, that the first lever arm is constructed for arresting the catch lever and is held in the arrested position of the catch lever by a first lever arm of the second safety lever and that the second lever arm of the first safety lever is positioned close to a coil of said electromagnet and is subject to the action of a coil pin of said electromagnet.

10. An electric door opener according to claim 9, characterized in that the first lever arm of the first safety lever has a stop edge, on which the catch lever in the arrested position catches with a detent on a front end region.

11. An electric door opener according to claim 9, characterized in that a first and a second lever arm of the second safety lever are vertically oriented and the first lever arm engages behind a front end region of the first lever arm of the first safety lever.

12. An electric door opener according to claim 11, characterized in that the first safety lever is positioned close to a locking plate-side housing wall and the second safety lever close to an inside housing wall and that the coil, the coil pin and a coil core of said electromagnet, which are jointly horizontally adjustable, are positioned between the first safety lever and the second safety lever.

13. An electric door opener according to claim 12, characterized in that, on energizing the coil, the coil core can be drawn into said coil against the bias of a compression spring.

14. An electric door opener according to claim 9, characterized in that the first safety lever is held in position arresting the catch lever by a compression spring, which is supported on a housing side and on the second lever arm of said first safety lever and on energizing the coil is pivotable by the coil pin adjusted with the coil core in counterclockwise direction, if the first lever arm of the second safety lever by the magnetic entrainment of the second lever arm is pivoted out of its impact-preventing position in the counterclockwise direction and the first lever arm of the first safety lever is released.

15. An electric door opener according to claim 6, characterized in that the coil core is so constructed that a venting and ventilation of a gap between the coil core and coil is ensured.

16. Arresting/release device according to claim 15, characterized in that the coil core has a vent hole for venting and ventilating the gap.

* * * * *